US005628217A

United States Patent [19]

Herrera

[11] Patent Number: 5,628,217

[45] Date of Patent: May 13, 1997

[54] ELECTRONIC-MECHANICAL LOCKING CYLINDERS

[75] Inventor: Luís Z. Herrera, Arechavaleta, Spain

[73] Assignee: Azbe B. Zubia S.A., Spain

[21] Appl. No.: 437,720

[22] Filed: May 9, 1995

[30] Foreign Application Priority Data

Nov. 18, 1994 [ES] Spain ..... 9402369

[51] Int. Cl.[6] ..... E05B 47/00

[52] U.S. Cl. ..... 70/279; 70/337; 70/283; 70/441

[58] Field of Search ..... 70/279, 283, 337, 70/340, 421, 379 R, 380, 276–278, 408, 411, 441

[56] References Cited

U.S. PATENT DOCUMENTS

| | | | |
|---|---|---|---|
| 3,889,501 | 6/1975 | Fort | 70/337 |
| 4,848,115 | 7/1989 | Clarkson et al. | 70/283 |
| 4,909,053 | 3/1990 | Zipf, III et al. | 70/380 |
| 5,010,750 | 4/1991 | Böser et al. | 70/283 |
| 5,351,042 | 9/1994 | Aston | 70/283 |
| 5,412,963 | 5/1995 | Carlo et al. | 70/279 |
| 5,423,198 | 6/1995 | DiVito et al. | 70/283 |

FOREIGN PATENT DOCUMENTS

| | | | |
|---|---|---|---|
| 278905 | 8/1988 | European Pat. Off. . | |
| 401647 | 12/1990 | European Pat. Off. . | |
| 526904 | 2/1993 | European Pat. Off. . | |
| 2199881 | 7/1988 | United Kingdom | 70/283 |
| 872735 | 5/1987 | WIPO | 70/283 |
| 9207156 | 4/1992 | WIPO | 70/283 |
| WO93/19267 | 9/1993 | WIPO . | |

OTHER PUBLICATIONS

Azbe B–Zubia, S.A. (Nov. 26–29, 1994).

CIC Productos Informacion with translation (Nov. 18, 1994).

Neueva Ferreteria, No. 106 with translation (Oct., 1994).

Schlussel, E. (1993) Protector 21:63 (XP 000355144).

KABA nova–eco (undated) with English translation.

BKS (EM–Zylinder) (undated) with English translation.

NEMEF (NEMEF–alpha) (undated) with English translation.

WINKHAUS High Security Electronic–Zylinder (undated) with English translation.

SEA (SEAtron) (undated) with English translation.

BKS (ESI) (undated) with English translation.

ZEISS IKON (Zeiss Ikon Ikotron) (undated).

ASSA electronic (Hotel Lock System) (undated).

DOM Sicherheitstechnik (TREND Line) (undated).

LIPS (After the first teeth . . . ) (undated).

*Primary Examiner*—Darnell M. Boucher

*Attorney, Agent, or Firm*—Klauber & Jackson

[57] ABSTRACT

The locking system includes a blocking and electronic releasing device by means of different codes for each one of the keys, it also being possible to modify the memory of the control circuit by means of an operating key to refuse access to a lost key, also allowing access to other new copies of the key. This electronic blocking is done by means of an independent pin of the locking pistons of the mechanical part of the cylinder, the latter being inside as well as outside the same. The key (4) communicates to the cylinder (1) its code by means of an electric contact (9) through which the energy required for its operation will be supplied to it. The transmission of data of the key to the cylinder is done by the electric contact itself (9). A rotary-type electric motor (10) acts on a blocking pin (6) by means of an eccentric (11) and connecting rod (12.) The control circuit of the cylinder (1) has a memory in which the codes of the keys (4) that have access to the lock appear. The control circuit will launch its reading process of the code of the key to allow or refuse retraction of the blocking pin (6.)

15 Claims, 1 Drawing Sheet

ELECTRONIC-MECHANICAL LOCKING CYLINDERS

OBJECT OF THE INVENTION

As is expressed in the title of this specification, the present invention refers to some improvements introduced in electronic-mechanical locking cylinders, achieving some advantageous objectives upon meeting the following conditions:

It does not differ from a conventional mechanical cylinder as far as its outside appearance is concerned, so that it may be installed in a lock of those already existing on the market, without any type of electric installation, upon replacing the existing cylinder by the new one by simply removing a screw.

In the event of any electronic anomaly it acts like a traditional mechanical cylinder given that the mechanical interlocking pistons are maintained outside as well as inside the door.

The owner will be able to communicate to the cylinder in a simple manner that a key has been lost. As of that moment, the cylinder will refuse access to said key.

It will be possible to make new copies of the key. These will only be able to open the lock if the owner so indicates it to the cylinder.

The key will not have a battery in order to operate and will include a code for each key.

The section of the cylinder may have other shapes other than the eurosection, it being able to be oval, round, square, etc. and it is also usable in motor vehicles.

BACKGROUND OF THE INVENTION

Presently a large variety of keys and mechanical type locking cylinders, wherein the key has on its surfaces and/or edges, the recesses or embossments that allow rotating movement of the rotor of the cylinder, upon none of the pistons preventing it as all of them are flush with the rotation surface, are known. This enables the lock to be operated.

Electronic devices that allow the lock to be opened by means of magnetic keys and remote control are also known.

In these systems alluded to if one loses a key, or else the remote control and its type and combination, respectively, are not known, normal opening of the lock becomes impossible and it will only be opened if the same is partially or totally destroyed.

In order to prevent a lost key from operating the cylinder, the same must be changed.

In the case of combined action locks, the transmission of the code or communication between the key and the lock, is done by means of an energy receiving coil, in other words, by means of electromagnetic induction. For this purpose the key includes in its electronic code circuit a ROM memory and a coil to capture the energy coming from the communication coil of the locking cylinder and to send the code to the control circuit, also done by magnetic induction.

DESCRIPTION OF THE INVENTION

In broad outline, the improvements introduced in electronic-mechanical locking cylinders, that comprise the object of the invention, permit the key to communicate its code to the cylinder by means of electric contact through which the energy required for its operation will be supplied to it.

The communication system of the cylinder with the key to read its electronic code is done by means of an electronic contact, thus it is totally reliable.

The supply of energy to the key as well as the transmission of the data are done by the same electric contact and for this purpose, the cylinder as well as the key will be provided with a series of contact elements with a suitable surface treatment to ensure the reliability of the whole.

The cylinder, by means of the above mentioned electric contact will supply the necessary energy to the key for the operation thereof. The key, upon being fed in this way, will return its code to the cylinder by the same way.

The mechanical operation of the control circuit on the cylinder, so that the electro-magnetic blocking takes place, or else, permitting the operation of the cylinder, in accordance with the information of the code received from the key, is carried out by means of an electromagnetic element that allows the electronic interface and that is defined by a rotary-type electric motor, making it necessary to convert rotating movement into linear movement by means of a cam. Thus it is achieved that a pin placed radially in the cylinder moves, it being susceptible to interrupting a blind perforation of the rotor.

The control circuit of the cylinder carries out the management of the different resources of the cylinder: communication, electromechanical interlocking system, battery levels, etc. and acting according to the functional algorithm that is described hereinafter.

It will contain a memory in which the codes of the keys that have access to the lock appear. Only the keys whose code is included in the memory will be able to open the lock. This lock will be able to be modified by the owner to eliminate or increase the number of keys, in the manner that is set forth hereinafter.

The possibility of connecting this circuit with the world outside the cylinder, so that in the future new performance qualities that require an outside feed, control and/or programming element may be introduced, is provded for.

For its part, the circuit of the key will be in charge of sending the electronic code to the cylinder as soon as it is feed. It consists of three main parts:

Code memory

Information transmission circuitry

Energy receiving contact and sending of the code.

The first two are integrated in a silicon circuit.

The feed battery is mounted in the cylinder and includes two easily replaceable batteries and preferably of the standard type.

The locking cylinder includes mechanical pistons in the part corresponding to the inside and outside sides of the same. The key includes housing for pistons on the larger surfaces as well as on the edges thereof. The need of space to house the new electronic-mechanical elements has made it necessary to eliminate part of the mechanical pistons on the inside side. Thus, one should distinguish between the inside surface and the outside surface of the cylinder. The first one will be accesible from the inside of the dwelling and the second one from the outside thereof.

When a key is inserted from the outside of the dwelling, its presence will be detected by means of the reading contact itself of the code, which will revive the control circuit. This will launch a reading process of the code of the key and if the code read has access to the lock, the electromagnetic element will withdraw the blocking bolt from the cylinder.

In this way and if the mechanical codes of the key and cylinder coincide, the user will be able to turn the key and operate the lock.

Upon removing the key, the electromagnetic element will block the cylinder again.

When the key is inserted from the inside, from the electric point of view the action is similar to that explained regarding the opening from the outside. The only difference lies in the loss of part of the mechanical safety.

The control circuit detects the death of the battery well in advance so as to withdraw the pin and unblock the cylinder, the cylinder functioning like a conventional mechanical cylinder.

Before this happens the user is warned that the battery is about to go dead, upon preventing opening during the first attempt, it being necessary to insert the key again so that the blocking pin retracts, carrying out this warning during the time that the failure persists, upon this order that is manifested in an interval of values or levels or energy of the batteries, pre-established, being recorded in the memory.

While the batteries are being changed and though all of the same are totally dead, the codes of the keys remain memorized in the memory and new programming is not necessary.

Besides the increase of safety that electronic recognition of the key implies, a new series of performance qualities are added to the cylinder:

Cancellation of lost keys

Allowing access to a new key

These two new operations would modify the contents of the memory of the control circuit that contains the codes of the keys that have access to the lock. An operating key is provided for this purpose.

Insertion of the operating key in the cylinder, through the inside as well as through the outside, indicates to the cylinder that a special operation of modification of the access code memory is going to take place. A key inserted afterwards would be included in the memory and could have access as of that moment to the lock.

If the operating key is inserted twice consecutively, the contents of the memory is erased. Advantageously this key lacks the footprints of access to the mechanical part of the cylinder, carrying only the electronic circuit for access to and operating in the memory.

When a key is lost, the user should proceed as follows:

The memory would be erased by means of the process described above.

The keys that he still has would be included in the memory. This is done by inserting alternately the operating key and then each one of the keys.

To validate other keys that the user does not have at that time and the new one acquired replacing the lost one, it suffices to insert the operating key once and alternately the remaining ones, though there are long intermediate time intervals.

As of then, the lost key cannot open the lock as its code is not in the memory.

Different alternatives of those that make new versions of the product made in accordance with the invention, for the feed system of the unit (by internal means, batteries, etc., or else external means batteries, linear sources, etc.); as well as by different blocking devices of the cylinder that can be used (rotary, two-stable motor, etc.); as well as by the different key coding types (stationary, changeable, cryptal), are provided for.

The memory of the control ASIC can be of several types (EEPROM, RAM, FLASH, etc.). The size thereof has no technical limitations.

The control ASIC could be connected to a data bus, allowing control of the lock by means of a computer system.

The function of the operating key may be done by other means. For example with a push button, or by sending the data by a bus, etc.

The transmission of data between the control ASIC and the key circuit can be done in several ways (by contact, inductive, capacitative, optical means, etc.)

To provide a better understanding of the features of the invention and forming an integral part of this specification, a sheet of drawings in whose figures the following has been represented in an illustrative and non-restrictive manner, is attached hereto:

DESCRIPTION OF THE PREFERRED EMBODIMENT

Figure 1:
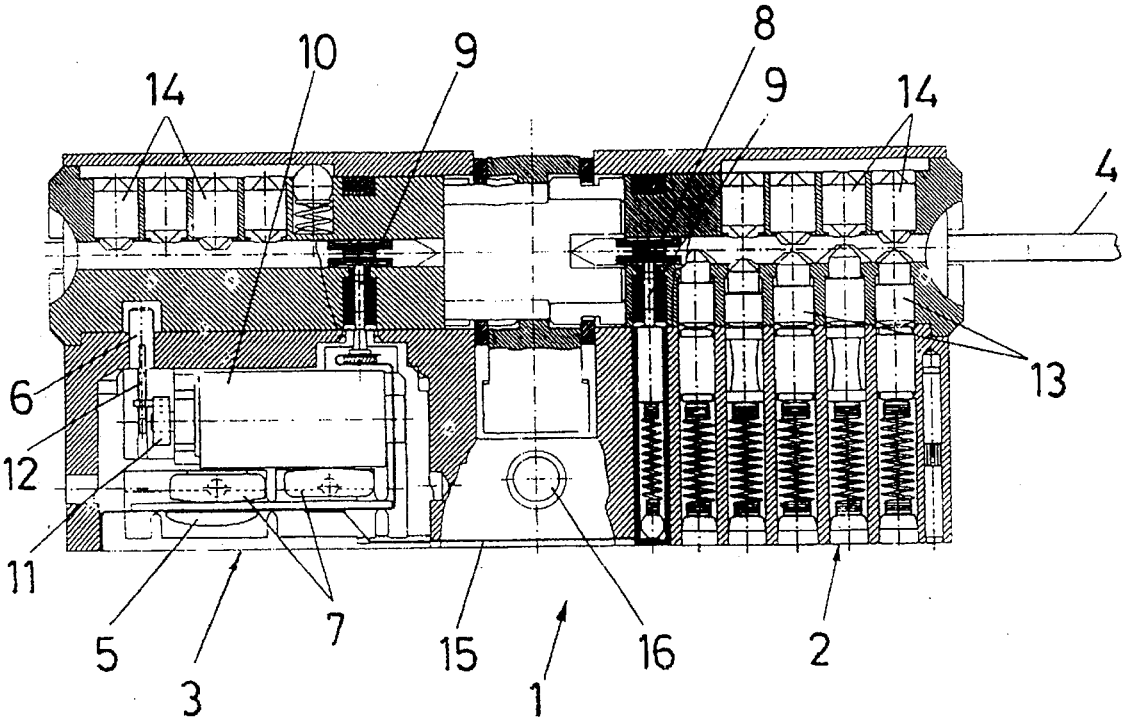
FIG. 1 is a longitudinal section of an electronic-mechanical locking cylinder, with the improvements object of the invention.

Making reference to the numbering used in the figures, we can see that the locking cylinder in which the improvements object of the invention are included, is generally referred to as number (1) and includes an outside part (2) and an inside part (3), the key being referred to as number (4.) The cylinder is very secure since inside the body of the cylinder (1) it has been possible to integrate an electronic security system, based on a control ASIC, referred to as number (5), including electromechanical operation for movement of the blocking pin (6) and the feed system by means of standard batteries (7.)

The key (3) includes in the end thereof the key circuit (8) with an unrepeatable identifying code. Upon being inserted through the inside (3) as well as through the outside (2) of the cylinder (1), its presence is detected by the reading contact (9.)

The electromagnetic element that facilitates the electronic-mechanical interface, is defined in this embodiment shown in the figures, by the electric rotary-type motor (10) whose shaft is pressed on the eccentric (11) connected to the blocking pin (6) by means of the connecting rod (12.)

The control circuit of the cylinder has a memory in which the codes of the keys (4) that have access to the lock appear. The memory of the code of the key circuit, as well as its information transmission circuitry are integrated in a silicon circuit, the code being communicated to the cylinder by means of the electric contact itself (9) through which the energy required for its operation is supplied.

Figure 2:
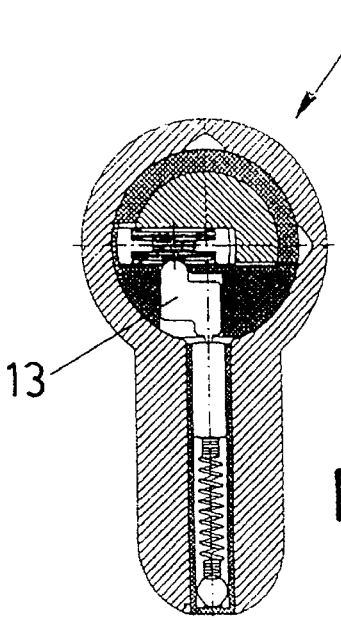
FIG. 2 is a cross section of that which is shown in FIG. 1.

Reference (13) designates the main pistons of the mechanical security system, existing on the outside side (2) of the cylinder (1), also being provided with other side blocking elements, materialized by the pistons (14) that are operated by the conical recesses of the key (4), existing on the larger surfaces as well as on the smaller ones, upon having in this preferred embodiment, two alignments shifted 90°, as is clearly inferred by observing FIG. 2.

In the inside part (3) of the cylinder (1) the mechanical interlocking defined by the main pistons (13) have been left out, since this area is to house the electric-electronic control elements, as well as to house the feed batteries (7.) The blocking pistons (14), shifted 90° in order to act on the surface and edge of the key (4), as is clearly seen in the left part of FIG. 1, are kept.

Reference (15) designates the communication cables to the ASIC.

This cylinder (1) has some standard measurements and can perfectly replace the one existing in the lock, by simply removing the screw entering the hole (16) that adequately secures the cylinder in the lock.

I claim:

1. An electronic-mechanical lock cylinder set, comprising:

(a) a plurality of keys, each key comprising:

a memory;

a first code electronically stored in said memory;

a second code embodied mechanically in said key;

an information transmission circuitry for transmitting said first code; and a contact for receiving energy and for transmitting said first code;

(b) an operating key; and (c) a lock cylinder comprising:

electronic circuitry;

a memory for electronically storing one or more codes;

a contact for transmitting energy to one of said plurality of keys when the key is inserted into the lock cylinder and for receiving said first code from the inserted key;

a first blocking element capable of preventing rotation of the cylinder while in an undisplaced position;

one or more second blocking elements capable of preventing rotation of the cylinder while in an undisplaced position;

at least one battery for providing energy for operation of the electronic circuitry;

a pre-established mechanical code;

means for reading said first code from the inserted key;

means for providing the inserted key with energy from said battery through the contact of the lock cylinder and the contact of the key;

means for comparing said first code read from the inserted key with the one or more codes stored in the memory of the lock cylinder;

means for displacing the first blocking element when said first code read from the inserted key corresponds to one of said codes stored in the memory of the lock cylinder;

means for reading said second code;

means for displacing said second blocking elements when said second code corresponds to the pre-established mechanical code;

means for detecting insertion of the operating key;

means for detecting the energy level of the battery;

means for determining when the battery energy level is below a first threshold; and means for issuing a warning that said battery level is low by preventing displacement of said first blocking element when said battery energy level is below the first threshold until one of said plurality of keys is inserted at least two consecutive times, and the first code of the twice inserted key corresponds to the one or more codes stored in the lock cylinder;

whereby said lock cylinder will be rotatable when the first and second blocking elements are displaced.

2. The electronic-mechanical lock cylinder set according to claim 1, wherein the electronic circuitry of the lock cylinder further comprises:

means for detecting two subsequent insertions of the operating key; and means to delete the codes stored in the lock cylinder memory upon detecting two subsequent insertions of the operating key.

3. The electronic-mechanical lock cylinder set according to claim 1, wherein the electronic circuitry of the lock cylinder further comprises means to add the first code of one of said keys to the lock cylinder memory upon insertion of the key subsequent to the insertion of the operating key.

4. The electronic-mechanical lock cylinder set according to claim 1, wherein the lock cylinder further comprises:

means for determining when the battery energy level is below a second threshold, said second threshold being lower than the first threshold; and means for displacing said first blocking element when the battery energy level is below the second threshold;

whereby the lock cylinder is capable of functioning as a mechanical lock cylinder; and whereby the lock cylinder is capable of being rotated by any one of said keys possessing the second code.

5. The electronic-mechanical lock cylinder set according to claim 1, wherein the electronic circuitry of the lock cylinder further comprises a control ASIC.

6. The electronic-mechanical lock cylinder set according to claim 1, wherein the key memory and the information transmission circuitry of the key are integrated in a silicon circuit.

7. The electronic-mechanical lock cylinder set according to claim 1, wherein the contact of the lock cylinder and the contact of the key each further comprise a series of contact elements.

8. The electronic-mechanical lock cylinder set according to claim 7, wherein said contact elements further comprise a surface treatment for enhancing electrical transfer.

9. The electronic-mechanical lock cylinder set according to claim 1, wherein said first blocking element further comprises a blocking pin.

10. The electronic-mechanical lock cylinder set according to claim 9, wherein the means for displacing the first blocking element further comprises a rotary-type electric motor having a shaft coupled to an eccentric which is connected to the blocking pin by a connecting rod.

11. The electronic-mechanical lock cylinder set according to claim 1, wherein said second code is defined by means of conical recesses in the shaft of each key.

12. The electronic-mechanical lock cylinder set according to claim 11, wherein said shaft has two larger surfaces and two smaller surfaces, said recesses being disposed on said larger surfaces and on said smaller surfaces.

13. The electronic-mechanical lock cylinder set according to claim 1, wherein said means for reading said second code and said means for displacing second blocking elements when said second code corresponds to the pre-established code further comprise one or more blocking pistons.

14. The electronic-mechanical lock cylinder set according to claim 13, wherein said lock cylinder further comprises an inside part and an outside part, wherein the blocking pistons are disposed on the outside part, and the battery, the electronic circuitry, an electric motor and the first blocking element are disposed on the inside part, and wherein said lock cylinder contact further comprises an inside contact disposed on the inside part and an outside contact disposed on the outside part, wherein the first code from one of said keys is capable of being transmitted through either of said inside or outside contacts.

15. The electronic-mechanical lock cylinder set according to claim 1, wherein the operating key is not provided with the second code.

* * * * *

UNITED STATES PATENT AND TRADEMARK OFFICE

CERTIFICATE OF CORRECTION

PATENT NO. : 5,628,217

DATED : May 13, 1997

INVENTOR(S) : Luis Zubia Herrera

It is certified that error appears in the above-indentified patent and that said Letters Patent is hereby corrected as shown below:

On the Title page, item [75]; Inventors name should read

--Luis Zubia Herrera--

Signed and Sealed this

Second Day of September, 1997

Bruce Lehman

*Attest:*

BRUCE LEHMAN

*Attesting Officer*

*Commissioner of Patents and Trademarks*